US006240733B1

(12) United States Patent
Brandon et al.

(10) Patent No.: US 6,240,733 B1
(45) Date of Patent: Jun. 5, 2001

(54) METHOD FOR THE DIAGNOSIS OF AN AIR CONDITIONING SYSTEM

(75) Inventors: Giles M. Brandon, Bascharage (LU); Charles Andrew Archibald, Lockport; Christopher M. Kachur, Amherst, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/488,858

(22) Filed: Jan. 21, 2000

Related U.S. Application Data

(63) Continuation-in-part of application No. 09/197,924, filed on Nov. 23, 1998, now abandoned.

(51) Int. Cl.[7] ..... G01K 13/00
(52) U.S. Cl. ..... 62/129; 62/149; 62/292
(58) Field of Search ..... 62/149, 292, 77, 62/129

(56) References Cited

U.S. PATENT DOCUMENTS

| | | | | |
|---|---|---|---|---|
| 3,299,648 | * | 1/1967 | White et al. | 62/149 |
| 3,301,001 | * | 1/1967 | McKinney | 62/149 |
| 3,302,421 | * | 2/1967 | Karnes | 62/149 |
| 3,303,663 | * | 2/1967 | Miller et al. | 62/149 |
| 3,400,552 | * | 9/1968 | Johnson et al. | 62/149 |
| 4,114,448 | * | 9/1978 | Merritt | 62/129 |
| 5,758,506 | * | 6/1998 | Hancock et al. | 62/77 |

FOREIGN PATENT DOCUMENTS

| | | |
|---|---|---|
| 63-17258 | 1/1988 | (JP) . |
| 1-193567A | 8/1989 | (JP) . |
| 2-101742 | 4/1990 | (JP) . |
| 4-3866A | 1/1992 | (JP) . |

* cited by examiner

*Primary Examiner*—Corrine McDermott
*Assistant Examiner*—Melvin Jones
(74) *Attorney, Agent, or Firm*—Patrick M. Griffin

(57) ABSTRACT

In a method for the diagnosis of an air conditioning system having a condenser, an evaporator, an expansion device and a compressor, the stroke of which can be set via a valve, a maximum compressor stroke is set abruptly when the air conditioning system is running and a pressure impulse arising in the high pressure side of the refrigerant circuit is measured in order to determine the degree of filling of the refrigerant circuit.

9 Claims, 1 Drawing Sheet

METHOD FOR THE DIAGNOSIS OF AN AIR CONDITIONING SYSTEM

This application is a continuation-in-part of U.S. Ser. No. 09/197,924 filed Nov. 23, 1998, now abandoned.

TECHNICAL FIELD

The present invention relates to a method for the diagnosis of an air conditioning system, in particular a vehicle air conditioning system having a condenser, an evaporator, an expansion device and a compressor, the stroke of which can be set via a valve.

BACKGROUND OF THE INVENTION

The above named air conditioning systems are known in principle and are used in particular in vehicles for the cooling of the vehicle cabin. The refrigerant circuit of these air conditioning systems is filled with a refrigerant, for example with R 134a (previously also R 12).

In air conditioning systems of this kind there is the problem that refrigerant must be added from time to time, since there is the danger when the level is low that the compressor housing heats up so much that the compressor is damaged or that the lifetime of the compressor is reduced respectively.

SUMMARY OF THE INVENTION

An object of the present invention is to provide a method for the diagnosis of an air conditioning system by means of which a statement about the degree of filling of the refrigerant circuit can be made.

A method for the diagnosis of an air conditioning system having a condenser, an evaporator, an expansion device (either an orifice or a thermal expansion valve) and a compressor, the stroke of which can be set via a valve, is characterized in that a maximum compressor stroke is set abruptly when the air conditioning system is running, whereupon a pressure impulse arising in the high pressure side of the refrigerant circuit is measured in order to determine the degree of filling of the refrigerant circuit.

The invention is based on the finding that as the refrigerant level decreases (or drops below a critical charge limit), there is a corresponding reduction in the high side pressure peak after a rapid upstroke. This phenomenon is used to define a critical charge-peak pressure curve which can be stored in the form of a look-up table. The method according to the present invention involves rapidly upstroking a variable displacement compressor, measuring the associated peak in high side pressure and comparing the value to the stored values in the look-up table.

According to the method of the present invention, the compressor lifetime can be extended by detecting refrigerant levels below critical charge which can cause overheating of the compressor. Thus, the present invention serves as a diagnostic aid for servicing the air-conditioning system. The present invention also provides a method for the diagnosis of an air conditioning system which can be realized with simple technical means. The present invention further provides a method for the diagnosis of an air conditioning system which can be carried out in an automated manner.

According to the present invention, there is no need for an evaporator outlet refrigerant temperature or pressure sensor. The low charge detection can be performed using just a high side pressure sensor in the air-conditioning system. This is advantageous since many air-conditioning systems only have a high side pressure sensor available.

Advantageous embodiments of the invention are described in the subordinate claims.

It is particularly advantageous when the maximum compressor stroke is set starting from a minimum compressor stroke, i.e. when the stroke of the compressor is changed within the shortest time from a minimum stroke to a maximum stroke. In this case the pressure impulse arising in the high pressure side of the refrigerant circuit is a maximum, which facilitates the evaluation.

It is advantageous when the measured pressure impulse is compared to predetermined pressure values and a diagnosis report is issued or not in dependence on this comparison. A diagnosis report of this kind can be an optical and/or an acoustical signal; or a corresponding warning can be shown on a display.

Through the comparison with predetermined pressure values, which can be established in test experiments, it can be determined whether the measured pressure impulse lies above or below a threshold value, which allows a conclusion to be drawn about an insufficient filling with refrigerant. In this it is advantageous when the measured pressure impulse is compared with pressure values which are stored in a look-up table and which in each case are associated with a specific degree of filling. Through this it is for example possible to issue a warning when a critical degree of filling is being approached and/or to block the air conditioning system when this critical degree of filling is reached or exceeded so that the driver is obliged to replenish the refrigerant.

It is particularly advantageous when the measured pressure impulse is compared with pressure values which are stored in a look-up table and which are associated in each case with a specific degree of filling in dependence on the ambient temperature. Through this procedure the influence of the ambient temperature can be taken into account.

In order to establish a critical degree of filling it can be determined in test experiments at which respective degree of filling a predetermined critical temperature of the compressor housing and/or of the refrigerant emerging from the compressor is reached. Through this a critical degree of filling can be defined which must not be dropped below in order that the critical maximum temperature is not exceeded.

It is particularly advantageous when the method in accordance with the invention is automatically carried out at predetermined time intervals, which can be done by an electronic control system. Through this the driver of the motor vehicle can be warned in time when the degree of filling is too low.

An electric valve is preferably used for the valve, for example a solenoid actuated valve, with the control of the valve preferably being done through a pulse width modulation. Through this it is for example possible to rapidly upstroke the compressor by stepping down the PWM valve duty cycle from 100% to 0%.

The pressure impulse which arises at the high pressure side of the refrigerant circuit can in principle be measured at an arbitrary location at the high pressure side. The outlet of the compressor or the outlet of the condenser is preferably used for the pressure measurement, with it being possible to use pressure sensors which in this case are already present so that no additional components are required.

The carrying out of the method in accordance with the invention is preferably done using an electronic control system, which on the one hand controls the valve of the compressor, and is connected on the other hand to a pressure sensor on the high pressure side. The corresponding comparison pressure values can also be stored in this control system.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
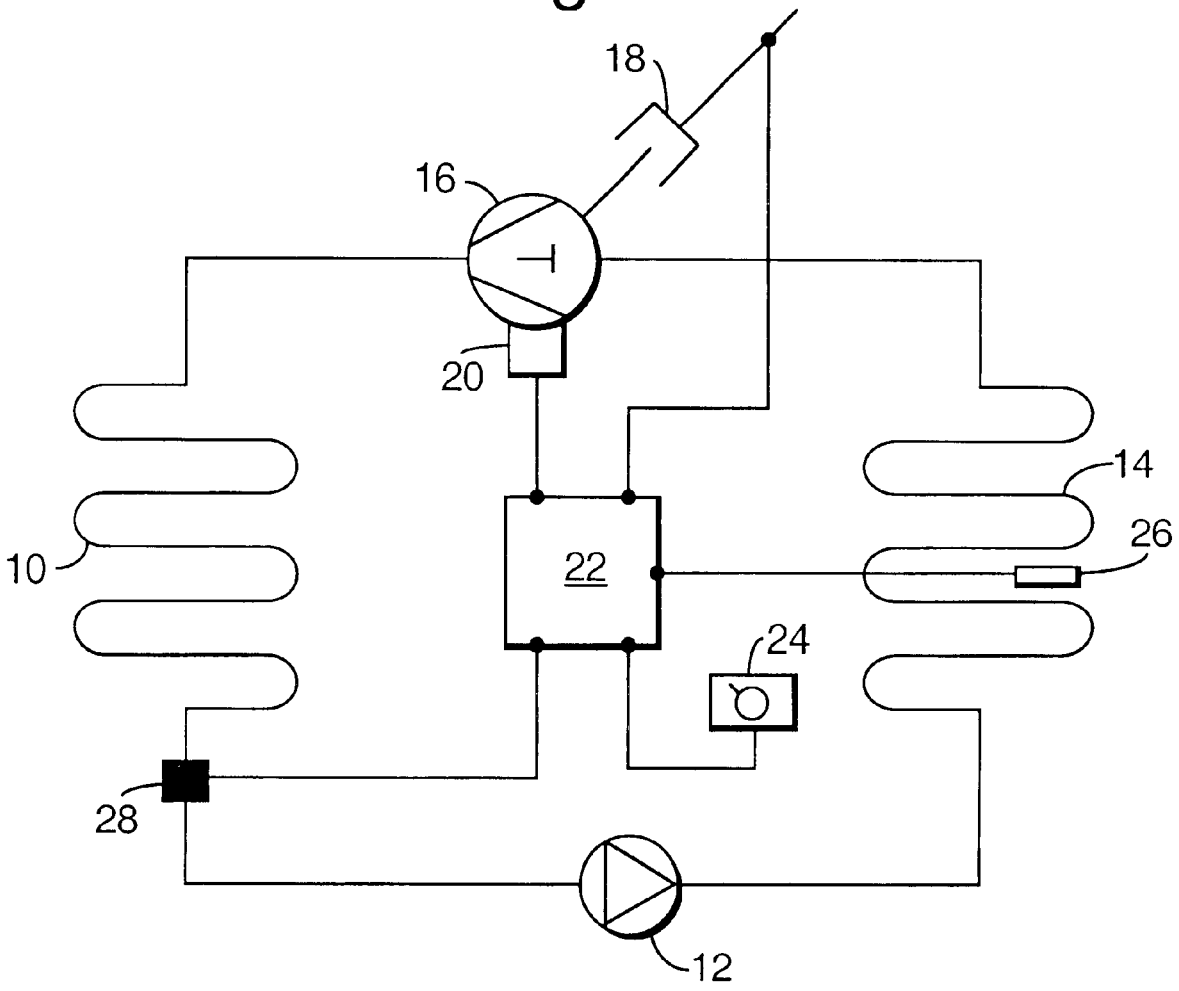
FIG. 1 shows a schematic illustration of an air conditioning system which is suitable for carrying out the diagnostic method in accordance with the invention.

As shown in FIG. 1, an air conditioning system, which can in particular be used as a vehicle air conditioning system, has a condenser (a first, outside, heat exchanger) 10, an expansion device 12, an evaporator (a second, inside, heat exchanger) 14 and a compressor 16 which are connected to one another in the named sequence. The compressor 16 is driven via a non-illustrated belt by the drive motor of a vehicle, preferably with (but possibly without) the drive to be coupled in via a clutch 18.

The compressor 16 is designed as a variable displacement compressor, with the displacement or stroke of the compressor being variable via a solenoid actuated valve 20.

An electronic control system 22 is provided for the temperature regulation of the air conditioning system illustrated in FIG. 1. A setting unit 24 for the setting of a desired cabin temperature is connected to the control system 22. Furthermore, the control system 22 produces electrical signals by means of a pulse width modulation which control the valve 20 of the compressor 16. The clutch 18 is likewise controlled by the control system 22, for example in order to effect a clutch engagement when the air conditioning system is switched on. Alternatively, the clutch 18 may be controlled by a different control unit, such as an engine control module.

A temperature sensor 26 which is connected to the control system 22 serves for the measurement of the evaporator outlet air temperature. Furthermore, a pressure sensor 28 which determines the condenser outlet refrigerant pressure and transmits it to the control system 22 is provided at the refrigerant outlet of the condenser 10.

In this preferred embodiment, the control system 22 is programmed in such a manner that the valve 20 is controlled at regular intervals in such a manner that it first sets a minimum stroke of the compressor, whereupon the valve is controlled in such a manner that it abruptly, i.e. in a short time, effects a maximum stroke of the compressor. Thereupon a pressure impulse arises in the high pressure side of the refrigerant circuit, i.e. between the compressor 16 and the expansion device 12, which is measured with the help of the pressure sensor 28. The peak value of this pressure impulse is read into the control system and compared there with stored pressure values. If the result of this comparison is that the measured pressure value lies in a critical range (preferably for a predetermined period of time), a warning report is issued by the control system 22.

A look-up table is contained in the control system 22 in which different pressure values are stored, by means of which the pressure impulse which is measured by the pressure sensor 28 is compared. The values to be experimentally determined for the creation of this look-up table were established on the basis of experimentation.

A low charge durability limit was determined by assessing the peak compressor body and refrigerant discharge temperatures at low charge conditions. Thereafter, a low charge detection routine was developed based on the peak compressor outlet and condenser outlet pressures observed when rapidly upstroking the compressor from minimum to maximum stroke position for different charge levels.

The critical charge and nominal charge were determined using a standard known charge determination procedure, and the compressor stroke position and the highest temperature between compressor body and refrigerant discharge temperatures were recorded for a number of different operating conditions and different charge levels of refrigerant fluid.

Care was taken during the tests not to allow the compressor body or refrigerant discharge temperatures to exceed a predetermined critical temperature. Further tests showed that, for a specific charge quantity and ambient condition, the compressor body and refrigerant discharge temperatures were worst when high compressor speed and displacement were combined together.

The present invention is usable with any form of variable displacement compressor in which the displacement or stroke is controlled through the regulation of crankcase pressure by a valve, including swash plate or wobble plate compressors. The valve may be a PWM solenoid valve, as mentioned above, or any other type of suitable valve, such as any frequency control valve, a PWM linear valve, a current controlled valve, or a memory shaped alloy valve.

What is claimed is:

1. Method for the diagnosis of an air conditioning system having a condenser, an evaporator, an expansion device and a compressor having a variable stroke which can be set via a valve so as to range from a minimum stroke to a maximum stroke, in said method the maximum compressor stroke being set abruptly when the air conditioning system is running, whereupon a pressure impulse which arises in the high pressure side of the refrigerant circuit is measured in order to determine the degree of filling of the refrigerant circuit.

2. Method in accordance with claim 1, wherein the maximum compressor stroke is set starting from the minimum compressor stroke.

3. Method in accordance with claim 1 or claim 2, with the measured pressure impulse being compared with predetermined pressure values and a diagnosis report being issued in dependence on this comparison.

4. Method in accordance with claim 1, with the measured pressure impulse being compared with pressure values which are stored in a look-up table and which are in each case associated with a specific degree of filling.

5. Method in accordance with claim 4, with the specific degree of filling being dependent on the ambient temperature.

6. Method in accordance with claim 1, with the measured pressure impulse being measured for a predetermined period of time.

7. Method in accordance with claim 1 or claim 6, with a critical degree of filling being determined in that a predetermined temperature of one of the compressor and the refrigerant emerging from the compressor is approached.

8. Method in accordance with claim 1, 7, with a solenoid actuated valve being used as the valve.

9. Method in accordance with claim 8, with the control of the valve being done through a pulse width modulation.

* * * * *